United States Patent [19]

Dongelmans

[11] Patent Number: 4,835,882

[45] Date of Patent: Jun. 6, 1989

[54] DRYER FLOW SEPARATOR

[75] Inventor: Anthony A. Dongelmans, Upland, Calif.

[73] Assignee: Challenge Cook Bros., Inc., Industry, Calif.

[21] Appl. No.: 115,758

[22] Filed: Oct. 30, 1987

[51] Int. Cl.[4] ..... F26B 11/02

[52] U.S. Cl. ..... 34/131; 34/133

[58] Field of Search ..... 432/222, 113, 176; 34/133, 131, 54, 122

[56] References Cited

U.S. PATENT DOCUMENTS

| | | | |
|---|---|---|---|
| 2,635,354 | 4/1953 | Geldhof et al. | 34/131 |
| 2,985,210 | 5/1961 | Magnuson | 34/122 |
| 3,061,942 | 11/1962 | Scofield | 34/133 |
| 3,081,554 | 3/1963 | Long | 34/133 |
| 3,750,304 | 8/1973 | Ghodiali | 34/131 X |
| 4,669,199 | 6/1987 | Clawson et al. | 34/133 X |

*Primary Examiner*—Steven E. Warner

*Attorney, Agent, or Firm*—Lyon & Lyon

[57] ABSTRACT

A drying unit flow separator includes an inlet having a curvature, and an exhaust duct and recirculation duct connected to the inlet at a junction. A recirculation damper is provided adjacent to the junction and projects into the inlet to divide the air flow between the exhaust duct on the outside of the curvature and the recirculation duct. A method of recirculating air to a drying unit includes the steps of blowing air into a curved duct causing larger and heavier lint particles to gravitate to the outside wall of the duct, and conducting the air past a recirculation damper such that the flow is divided into a recirculation flow and an exhaust flow that includes the larger and heavier lint particles.

13 Claims, 2 Drawing Sheets

DRYER FLOW SEPARATOR

BACKGROUND OF THE INVENTION

The field of the present invention is flow separators. More specifically, the invention relates to a flow separator for use in a drying unit, such as a textile dryer.

In textile or clothing dryers, during the drying process, lint is released from the articles being dried and is picked up by the air flow in the dryer. The lint may then collect in air ducts within the dryer and cause a reduction in air flow and a loss of drying efficiency. In addition, lint build up may interfere with moving electrical contacts and moving mechanical dryer parts.

Typically, in a dryer, articles to be dried are brought into contact with hot and relatively dry air provided by a heater or burner. During the drying process, the air cools somewhat and picks up moisture from the drying articles. The air is then removed from the dryer as exhaust air. As this dryer exhaust air is generally at a temperature substantially above ambient temperature, recirculating the dryer exhaust air can reduce the heat energy requirements of the dryer, and correspondingly reduce operating costs. However, merely reheating the dryer exhaust air and reintroducing it into the dryer would also recirculate the moisture and lint into the dryer would also recirculate the moisture and lint in the exhaust air into the dryer.

SUMMARY OF THE INVENTION

The present invention is directed to a flow separator which is particularly adapted, but not limited, to use in clothing or textile drying units. To this end, a recirculation passageway and damper are disposed within a recirculator assembly, in such a way that dryer exhaust air drawn from a drying chamber is essentially divided into a recirculation flow which is directed back into the drying chamber, and an exhaust flow which may be purged. The recirculator assembly includes a curved passageway to provide for separation of the recirculation and exhaust components.

Accordingly, it is an object of the present invention to provide a drying unit flow separator which separates lint-laden and heavier moisture-rich air from relatively lint-free drier and warmer air exhausted from a drying chamber. Other objects and advantages will appear hereinafter.

BRIEF DESCRIPTION OF THE DRAWINGS

In the drawings, wherein similar reference characters denote similar elements in both views.

DETAILED DESCRIPTION OF THE PREFERRED EMBODIMENT

Figure 1:
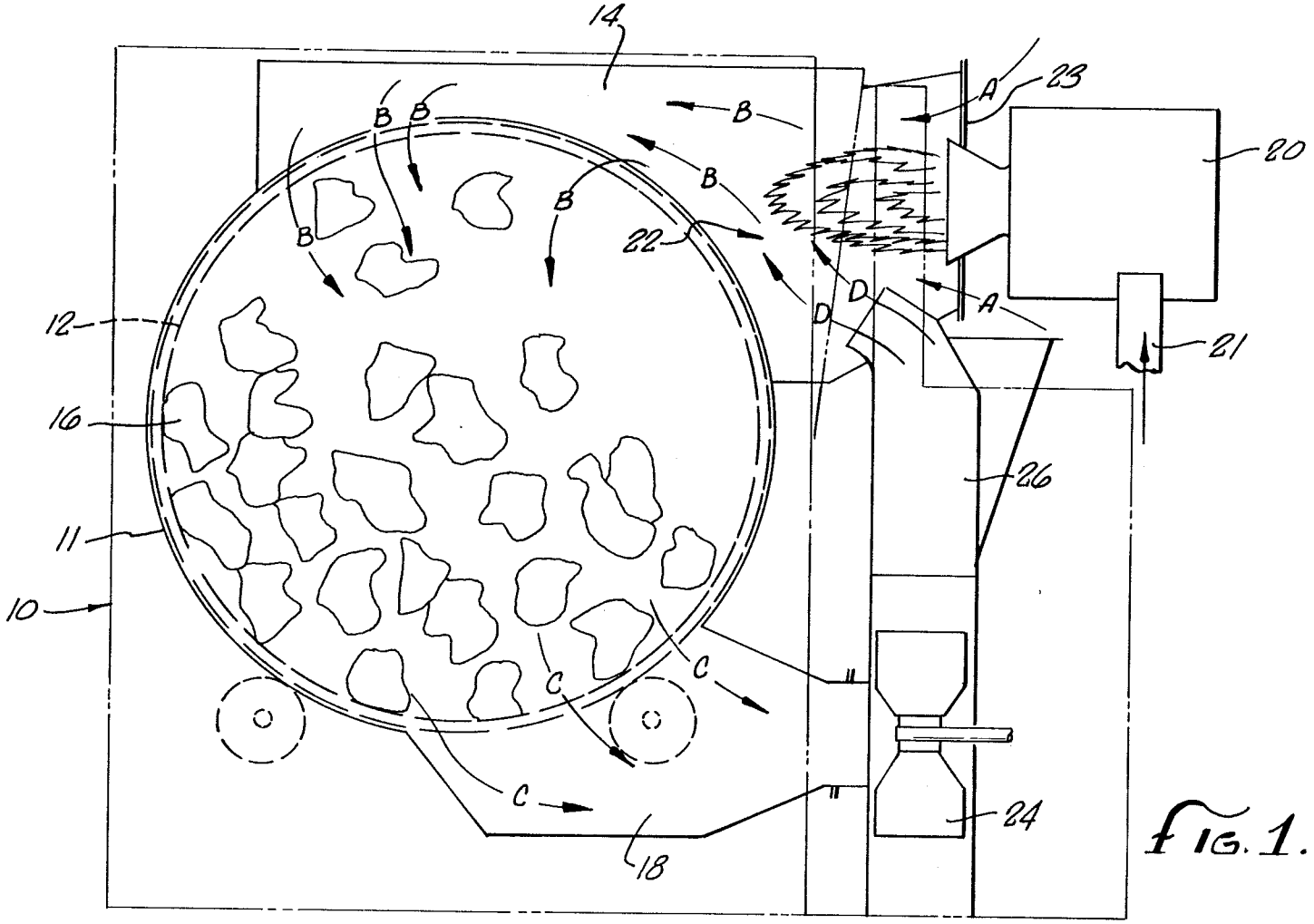
FIG. 1 is a schematic end view of a dryer having the flow separator of the present invention.

Turning in detail to the drawings, FIG. 1 illustrates a dryer 10 having a rotating basket 12 within a dryer chamber 11. The articles 16 to be dried are placed within the rotating basket 12 and tumble about therein during the drying process. In order to supply heat for drying the articles 16, a burner assembly 20 provides a heating flame within a combustion zone 22. Combustion air is provided to the burner assembly 20 through a burner intake 21. A heated air inlet duct 14 encompassing the combustion zone 22 conducts the hot air provided by the flame of the burner assembly 20 into the drying chamber 11. Openings 23 are provided in the region of the combustion zone 22 to allow outside fresh air of ambient temperature and humidity, designated by arrows "A", to enter the combustion zone 22. An exhaust duct 18 is connected to the drying chamber 11, opposite to the heat inlet duct 14, and leads away from the drying chamber 11 to a recirculation blower 24.

Figure 2:
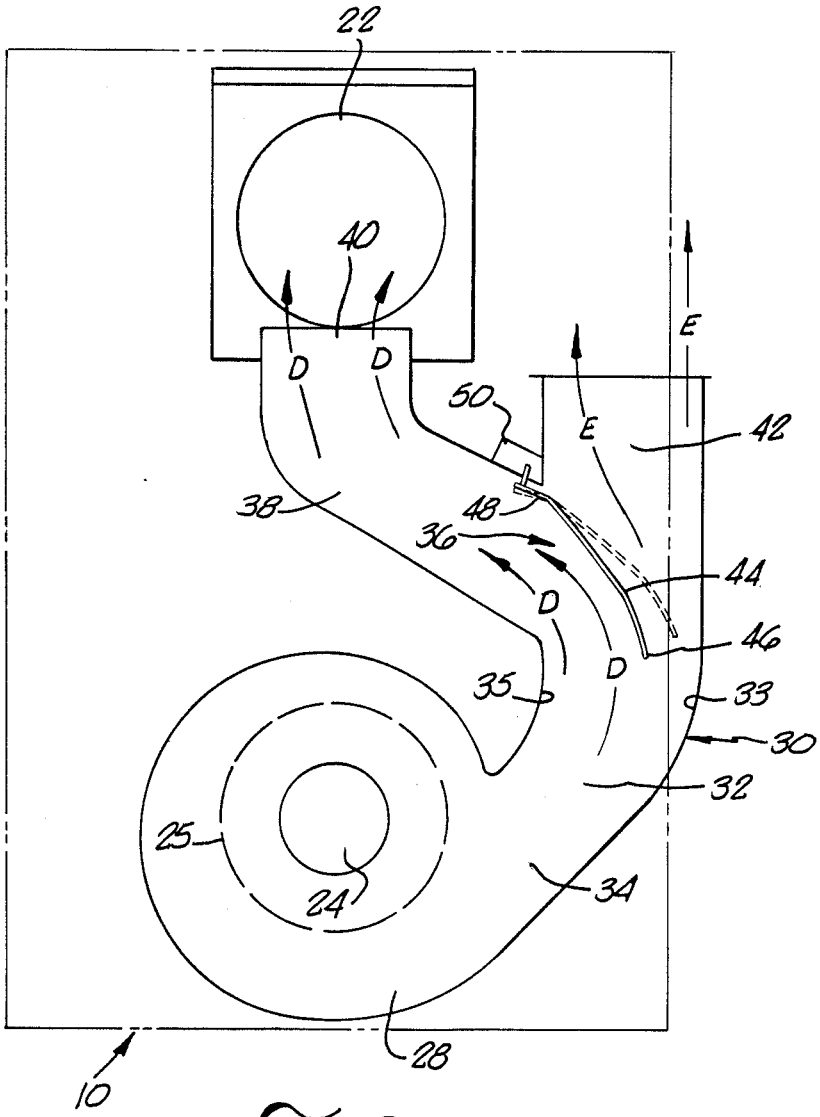
FIG. 2 is a schematic side view thereof.

With reference to FIG. 2, the recirculation blower 24 includes a blower wheel 25 which rotates within a blower plenum 28. The plenum 28 is connected to an inlet 32 of a recirculator assembly 30. The inlet 32 of the recirculation duct assembly (which may also be considered as the outlet of the blower plenum 28) has a smooth curvature, and specifically, a smoothly curved outside wall 33.

A recirculation duct 38 joints the inlet 32 at a junction 36 and has an outlet end 40 positioned adjacent to the combustion zone 22. The recirculation duct 38 may have a curvature approximately matching that of the inlet. An exhaust duct 42 is also joined to the inlet 32 at the junction 36, with the inlet, recirculation duct, and exhaust duct preferably forming a generally Y-shaped recirculator assembly 30, as shown in FIG. 2. The recirculation duct 38 and the exhaust duct 42 may have flow cross sections equivalent to that of the inlet 32 in the region of the junction 36. The inlet 32 cross section optionally gradually increases as the inlet 32 extends from the inlet end 34 to the junction 36. Each of these flow passageways should be provided with smoothly curved contours to prevent lint build up.

A recirculation damper 44 is positioned within the recirculator assembly 30 in the region of the junction 36. The leading edge 46 of the recirculation damper 44 projects at least partially into the curved section of the inlet 32. The leading edge 46 may be curved in the direction of the inlet curvature, or the entire damper 44 may be so curved. To provide a means for adjusting the rate of recirculation, the recirculation damper 44 can be pivotally mounted at its trailing edge 48 such that the recirculation damper 44 is movable within the recirculator assembly 30, to adjust the division of air flow between the recirculation duct 38 and the exhaust duct 42. An actuator 50 controls the position of the recirculation damper 44.

In operation, articles 16 to be dried are placed within the rotating basket 12. The burner assembly 20 provides a flame within the combustion zone 22. Fresh air "A" at ambient temperature and relative humidity is drawn through openings 23 into the combustion zone 22. Air "A" is heated within the combustion zone 22 and becomes "B" air, i.e., very hot (lint-free) air with low relative humidity. Air "B" then travels through the heat inlet duct 14 into the rotating basket 12. After passing through and/or over the articles 16, air "B" flows out of the rotating basket 12 and drying chamber 11 as "C" hot air with high relative humidity and a mixed lint content.

Air "C" then flows to the recirculation blower 24 wherein the air "C" and the lint are expelled by the blower wheel 25 into the blower exhaust duct or inlet 32 of the recirculator assembly 30. Heavier, larger lint particles tend to travel in a straight line rather than follow the curved path of the inlet 32 and therefore the lint particles travel toward the outside wall 33 where they are carried by the moving "E" hot air past the outside of the recirculation damper 44, and into the exhaust duct 42 for collection further downstream. Lighter and smaller lint particles are "captured" by the recirculation damper 38 and travel as "D" hot air flow to the burner flame in the combustion zone 22. Upon reaching the combustion zone 22 these lint particles are burned, thereby avoiding lint build-up inside the dryer unit.

As air "C" leaves the blower plenum 28, the cooler, more dense air also tends to travel toward the outside wall 33 of the recirculator assembly 30 and is thus carried past the outside of the damper 46 into the exhaust duct 42 (flow "E"). Warmer lighter air, on the other hand, is captured by the recirculation damper 44 and is directed into the recirculation duct 38 for recirculation "D" into the dryer heat inlet duct 14, thereby increasing the efficiency of the dryer.

Moist air expelled from the blower plenum 28 also separates within the curved inlet 32 with the moisture-rich, heavier air gravitating towards the outside curved wall 33 of the recirculator assembly, with this air "E" then moving past the plenum into the exhaust duct 42. Dryer and lighter air, which remains closer to the inside wall 35 of the inlet 32 is diverted by the damper 44 into the recirculation duct 38 and flows back into the dryer 10 (flow "D").

Thus, a flow separator is disclosed which separates hot, moisture-rich and lint-laden air by centrifugal force into a recirculation flow of relatively dry and lint-free recirculation air, and an exhaust flow of lint-laden, relatively cool, and moist air. While a single embodiment and application of this invention has been shown and described, it would be apparent to those skilled in the art that many more modifications are possible without departing from the inventive concepts herein. The invention, therefore, is not to be restricted except in the spirit of the appended claims.

What is claimed:

1. A drying unit flow separator comprising: an inlet duct having walls forming a curvature with an outside wall on an outer radius of the curvature and an inside wall on an inner radius of the curvature; a recirculation duct;

an exhaust duct, said recirculation duct and said exhaust duct connected to said inlet duct at a junction with said recirculation duct continuing from the inside wall on the inner radius and said exhaust duct continuing from the outside wall on the outer radius; and a recirculation damper disposed adjacent to the junction and projecting at least partially into said inlet.

2. The drying unit flow separator of claim 1 wherein said recirculation damper has a curvature approximately equivalent to the curvature of said inlet duct.

3. The drying unit flow separator of claim 1 further comprising positioning means for changing the position of said damper within said recirculation duct.

4. The drying unit flow separator of claim 1 further comprising a centrifugal blower connected to said inlet duct.

5. The drying unit flow separator of claim 1 wherein at least the leading edge of said damper is curved in the direction of curvature of said inlet duct.

6. The drying unit flow separator of claim 1 wherein said inlet duct has a cross section which gradually expands between said outside wall and said inside wall towards the junction.

7. The drying unit flow separator of claim 1 wherein said damper is movable from a closed position wherein said recirculation duct is substantially closed off from said inlet duct, to an open position wherein said exhaust duct is substantially closed off from said inlet duct.

8. The drying unit flow separator of claim 1 wherein said inlet duct includes an end connectable to a blower and said recirculation duct includes an end connectable to a heat inlet duct.

9. The drying unit flow separator of claim 1 wherein said recirculation duct and said exhaust duct are generally positioned above said inlet duct.

10. A drying unit flow separator comprising:

a smoothly curved inlet;

a recirculation duct;

an exhaust duct joined to said inlet duct and said recirculation duct at a junction, said exhaust duct, recirculation duct and said inlet duct forming a generally Y-shaped recirculatory assembly with the recirculatory duct extending from an inner curvature of the inlet duct and the exhaust duct extending from an outer curvature of the inlet duct; and a plate-like recirculation damper disposed within said recirculator assembly, said damper having a trailing edge pivotally joined to said recirculator assembly adjacent to said junction, and a leading edge projecting at least part way into said curved inlet duct.

11. A method of recirculating air in a drying unit comprising the steps of:

collecting lint-laden moist air from a drying chamber;

blowing the air at a predetermined velocity into a curved duct such that larger and heavier lint particles as well as heavy moist and cool air gravitate to an outside curvature of the curved duct;

conducting the air within the curved duct past a damper, such that the flow of air is divided into an exhaust flow from along the outside curvature of the curved duct primarily containing larger pieces of lint and heavy moist cool air, and a recirculation flow from an inside curvature of the curved duct containing lighter warm dry air with small lint particles; and directing the recirculation flow first to a burner, where the lint particles are burned, and then into the drying chamber.

12. The method of claim 11 further comprising the steps of directing the exhaust flow away from the drying chamber, removing lint from exhaust flow, and purging the exhaust flow.

13. The method of claim 11 further comprising the step of changing the position of the damper to adjust the rate of recirculation flow.

* * * * *